United States Patent [19]

Kraeger

[11] Patent Number: 5,012,893

[45] Date of Patent: May 7, 1991

[54] MULTI-PURPOSE SAWHORSE

[76] Inventor: Thomas F. Kraeger, 306 W. Davies Ave. N., Littleton, Colo. 80120

[21] Appl. No.: 448,721

[22] Filed: Dec. 11, 1989

[51] Int. Cl.[5] ..... B27B 21/00; B25H 1/06

[52] U.S. Cl. ..... 182/153; 182/181; 182/225

[58] Field of Search ..... 182/153, 181–186, 182/224, 225, 226, 223

[56] References Cited

U.S. PATENT DOCUMENTS

| | | | |
|---|---|---|---|
| 249,508 | 11/1881 | Douns | 182/153 |
| 288,651 | 11/1883 | Miller | 182/153 |
| 295,269 | 3/1884 | Miller | 182/153 |
| 1,742,637 | 1/1930 | Dearborn | 182/153 |
| 4,620,613 | 11/1986 | Albertson | 182/153 |

*Primary Examiner*—Reinaldo P. Machado
*Attorney, Agent, or Firm*—Frank P. Grassler

[57] ABSTRACT

A sawhorse of the folding leg type, characterized by having three sets of outwardly folding legs that are held in the open position by three pairs of attached braces, that in turn are attached to a bar that runs parallel to the beam of the sawhorse, which bar allows a user to simultaneously open or close the braces and in turn open and close the legs of the sawhorse. The sawhorse is further characterized in that, once the braces are opened and locked, the sawhorse can be turned onto a side or either end, so as to support downward-bearing loads in any one of these orientations.

14 Claims, 4 Drawing Sheets

MULTI-PURPOSE SAWHORSE

BACKGROUND OF THE INVENTION

The invention relates to portable work-supporting or object-supporting devices in general, and in particular to sawhorses of the type for supporting lengthy objects to be worked on, which sawhorse can be folded up or knocked down for compact storage or easy transportation.

Sawhorses, sawbucks and the like are generally used for various purposes. They are most widely used in the carpentry and construction fields and in the home and in businesses to provide temporary supports for various materials and supplies, and in the making of scaffolds or shelf supports by the simple expedient of laying boards or planks across two or more of them. They are widely used as barricades on highways and parking areas and in crowd control. They are frequently used in temporary locations so that easy portability, which is important in such situations, is achieved. In most instances, they are stored between periods of use and it is thus important that they be capable of easy assembly or disassembly so that they can be stored compactly. They should also be made of resilient material that can withstand repeated blows or impacts and be resistant to splintering and corrosion.

Sawhorses consisting of a horizontal beam to which two pairs of diverging wooden legs are nailed or fixed have been widely used in the past. Such sawhorses cannot be easily knocked down. Sawhorses that can be knocked down have been made in which the legs are attached to the horizontal beams by means of bolts, screws, clamps or special brackets. These can be taken apart, but not easily and the clamps, bolts or screws that hold the sawhorses together were frequently lost or misplaced. Sawhorses of this character have been made of wood, which is subject to splintering, warping and rotting, and of metal, which may rust and corrode and otherwise require protective coating. The necessity of securing parts of the sawhorse together by separate screws, bolts, or clamps makes them inconvenient to assemble or disassemble and increases the liklihood of misplacing a critical part when assembly is desired. Also, conventional sawhorses are only capable of providing one work height. If the worker desires to raise work height, material must be placed under the legs of the sawhorse, or longer legs must be cut. If lower work position is desired, shorter legs must be cut.

Therefore, there is a need in this art for a sawhorse that can be easily assembled or collapsed, without requiring separate clamps, bolts or screws that can be misplaced, that is materially durable, easy to store, and capable of providing different work heights without altering the material of the sawhorse. The present invention provides for each of these needs.

SUMMARY OF THE INVENTION

The present invention has the following objects:

(1) being foldable along the axis of its cross beam;

(2) being capable of being constructed of any resilient material;

(3) being capable of bearing loads on its cross beam, or on either of two base beams, or on its side, to provide the user with three different heights upon which to place work; and (4) not requiring any hardware that is not permanently affixed or attached to the sawhorse.

Further objects include the provision of a sawhorse that, when assembled and in use, will not accidently come apart under ordinary use.

According to the present invention, these and other objects are accomplished by the provision of a collapsible horse, capable of supporting downward-bearing loads on any one of three possible orientations along its height, length or breadth, comprising a cross-beam member of pre-determined length, at least two pairs of legs connected to the cross beam member, which leg pairs are laterally disposed along the cross beam member, and are downwardly divergent in a plane transverse to that of the cross beam member, two base beam members running substantially parallel to the cross beam member, having substantially similar length as that of the cross beam member and to which the pairs of legs are connected, and a plurality of base beam braces in one-to-one association with each of the pairs of legs, each brace being connected to a pair of the legs and each brace being pivotable about a hinge means. This construction ensures that the assembled sawhorse will not accidentally fold up during use, and that it will have sufficient rigidity to enable it to be used as a support in three orientations, that is, along its height, as are conventional sawhorses, along its length when it is turned on end, and along its breadth when it is turned on its side.

BRIEF DESCRIPTION OF THE DRAWINGS

In FIG. 1 the sawhorse is oriented such that a load will rest on the sawhorse downwards along line 1—1.

DETAILED DESCRIPTION OF THE PREFERRED EMBODIMENTS

Figure 1:
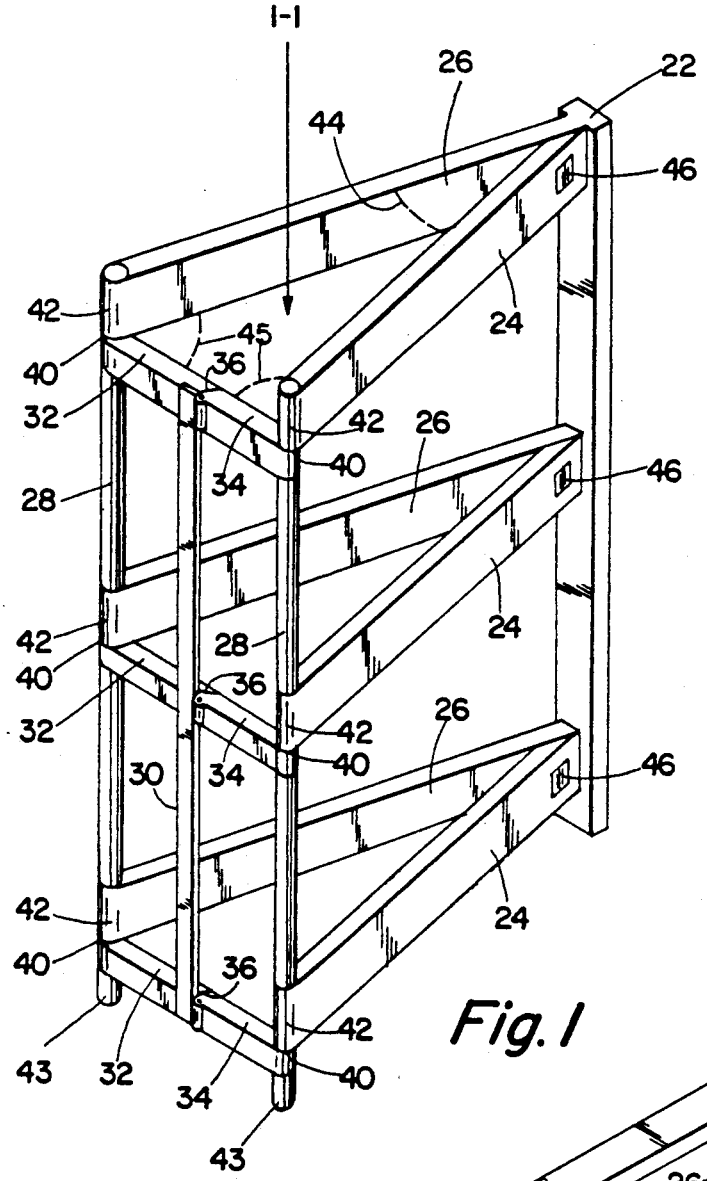
FIG. 1 is a perspective view of the assembled, unfolded sawhorse made according to the most preferred embodiment of the invention.
Figure 2:
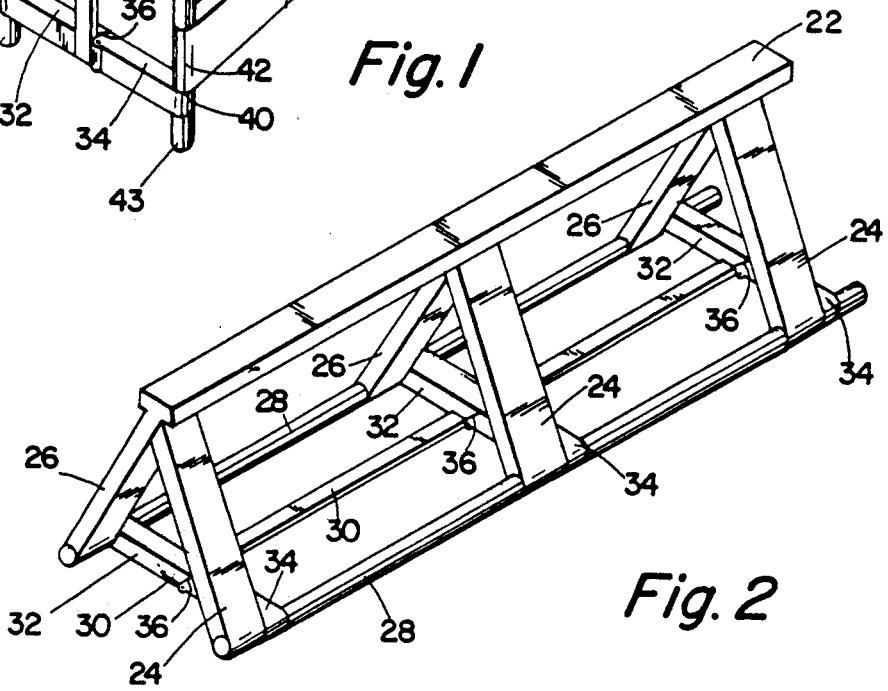
FIG. 2 is a perspective view of the sawhorse in its conventional, heightwise orientation.

Turning first to FIGS. 1 and 2, there is shown a preferred embodiment of the shophorse. The sawhorse has been fully unfolded, with the primary leg 26 divergently opened and swung away from the secondary leg 24, and with the base beam braces 32 and 34 fully extended, the details of which will be more fully explained below. The cross beam 22 is fixably attached to the primary leg 26. The secondary leg 24 is hingeably attached to the primary leg 26 in the most preferred embodiment of the invention, so that the legs can swing divergently away from each other along arc 44 from a folded to an unfolded position. At least two pairs of legs are needed in the sawhorse, and in the most preferred embodiment of the invention, three pairs of legs are present as shown. The divergence of the legs in the unfolded position is limited by the unfolded combined length of base beam braces 32 and 34 hingeably attached to the base beams 28 by hinge means 40, which base beams are fixably attached to the primary and secondary legs 26 and 24 at point of attachment 42. The base beam braces are present in pairs, one pair for each pair of legs, in the most preferred embodiment. The base beam braces, besides being hingeably attached to the base beams 28, are also hingeably attached to each other, meeting at point 36. The base beam braces pivot about point 36 along arcs 45 from a folded to an unfolded position. This is also shown in side view in FIG. 3. It can be seen from FIG. 3 that the legs 26 and 24 and the braces 32 and 34 form a triangle, which in turn roughly constitutes a triangular plane.

In FIG. 1, the shophorse is oriented upright along its length, rather than along its height, as conventional sawhorses normally are. This is possible due to the construction whereby a tripod is formed by the cross beam 22 and the two base beams 28, held in their triangular relationship by the primary leg 26, the secondary leg 24 and the base beam braces 32 and 34. At the base of the thus-formed tripod, the lengths of the cross beam 22 and the base beams 28 are extended beyond the plane formed by the legs and the braces, in the most preferred embodiment, by extensions 43.

A pick-up bar 30 is attached to either of the braces 32 or 34, which bar is shown to run substantially parallel with the beams. A user can grasp the pick-up bar, and by a motion inwardly or outwardly cause the braces to swing about their arcs 45, which in turn will simultaneously cause the connnected legs to swing in their arc 44 accordingly, thus either folding or unfolding the sawhorse.

Figure 3:
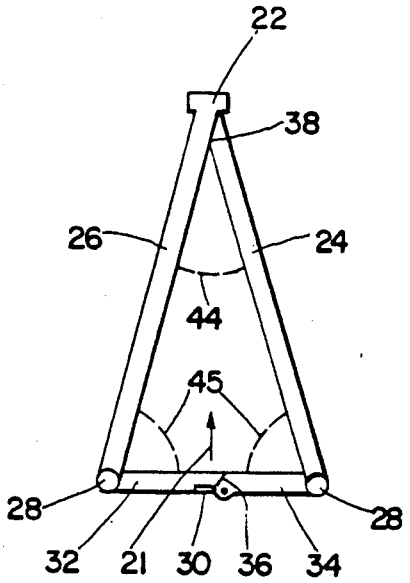
FIG. 3 is a top plan view illustrating the arc along which the diverging legs swing open and shut, and also illustrating the arc along which the base beam braces swing open and shut about their pivot point.
Figure 4:
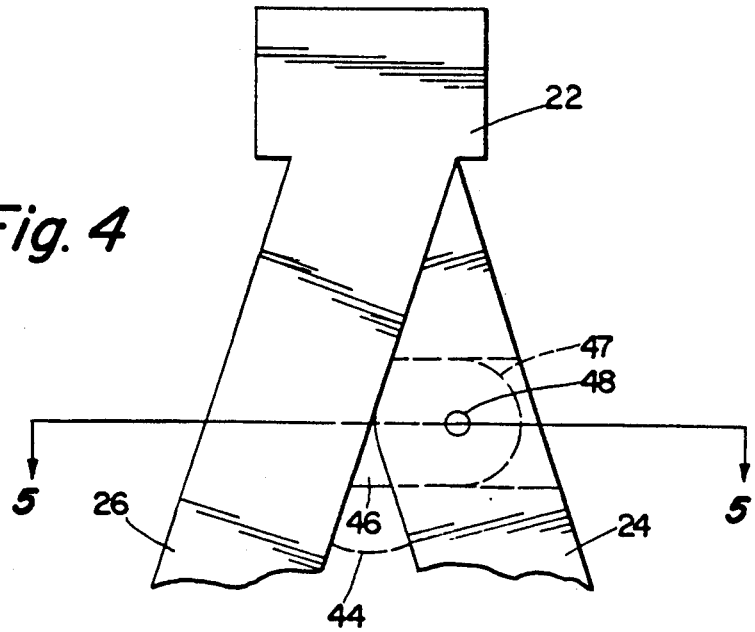
FIG. 4 is a fragmentary top plan view showing in greater detail a preferred embodiment of a hinge means about which the legs of the sawhorse swing open and shut.
Figure 5:
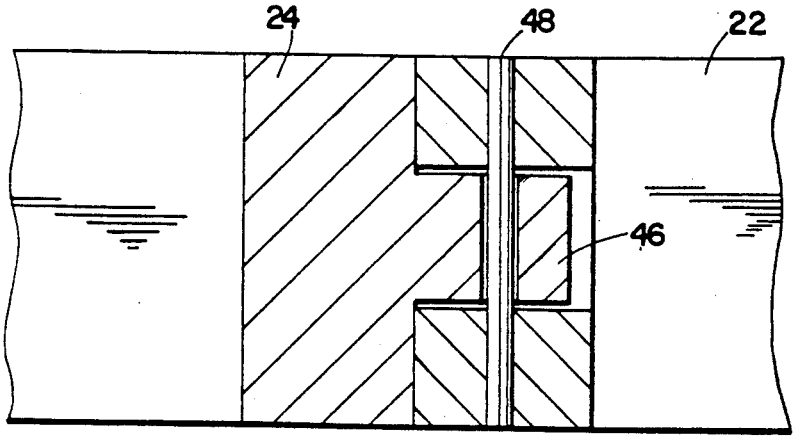
FIG. 5 is a fragmentary cross-section, through the line 5—5 of FIG. 4, showing the hinge means described in the preceding paragraph.

Turning now to FIGS. 4 and 5, there are shown an enlarged detail from FIG. 3, and a frontal view taken along line 5—5, respectively. In FIG. 4 the side view of the primary leg 26 shows that in the most preferred embodiment, a primary leg will have a male hinge knuckle 46 that interdigitates with a pair of hinge knuckles or into a female recess 47 in the secondary leg 24, pivoting about a pin 48 inserted into a bore configured for receiving the pin, which bore runs through the knuckle 46 of the primary leg and the knuckles or recessed area of the secondary leg 24.

The primary leg 26 is shown being an integral part of, and indistinguishably attached to, the cross beam 22, as would be the case if the beam and primary leg had been fabricated by injection molding as a single piece out of a suitable polymer. The primary leg 26 may also be fixably attached to the cross beam 22 as two separate pieces joined by any means well known to those of skill in the art.

The secondary leg 24 is also shown in this preferred embodiment as having its top face being at an angle to the sides of the secondary leg, instead of being normal to the sides of the secondary leg. It will be noted that this angle is conformed so as to fit flush against the surface of the primary leg in contact with it, when the sawhorse is unfolded, as shown in FIGS. 1, 3 and 4. This feature acts to help stabilize the sawhorse when it is unfolded, by giving a solid base against which the downward forces of a load being exerted on the pin of the hinge means can be more evenly distributed onto the surface of the primary leg.

Figure 6:
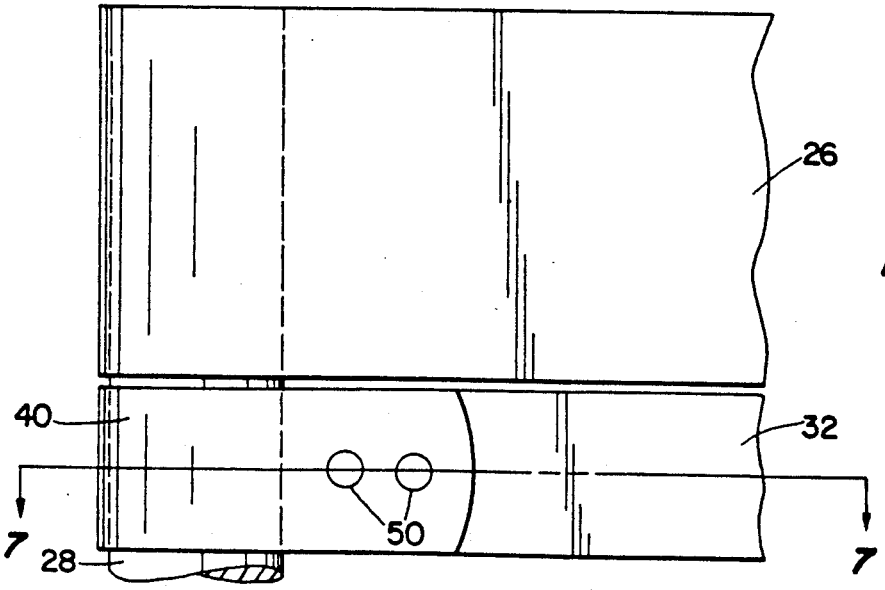
FIG. 6 is a fragmentary side view of a preferred embodiment of another hinge means about which the braces of the sawhorse swing open and shutwith respect to the base beams.
Figure 7:
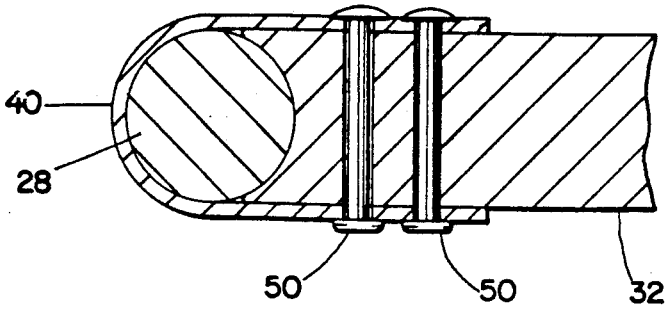
FIG. 7 is a fragmentary section taken along the line 7—7 of FIG. 6, showing the hinge means described in the preceding paragraph.

FIGS. 6 and 7 show details of a hinging means that permit rotation of the braces 32 and 34 with respect to the base beams 28. In the most preferred embodiment, a hinge strap 40 is fixably attached by pins or rivets 50 onto a brace 32 or 34, with the strap simply covering a semi-circular portion of the base beam 28, around which brace 32 or 34 partially rotates.

Figure 8:
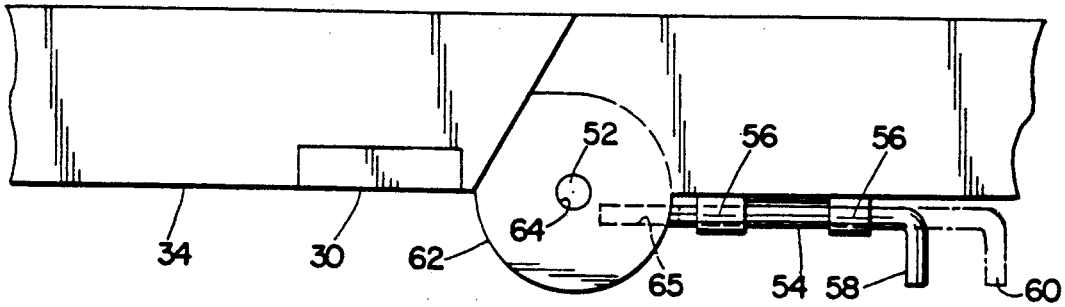
FIG. 8 is a fragmentary side view of the hinged pivot point about which a pair of the braces swing with respect to each other, also illustrating a preferred embodiment of a means for locking the braces in the open position.
Figure 9:
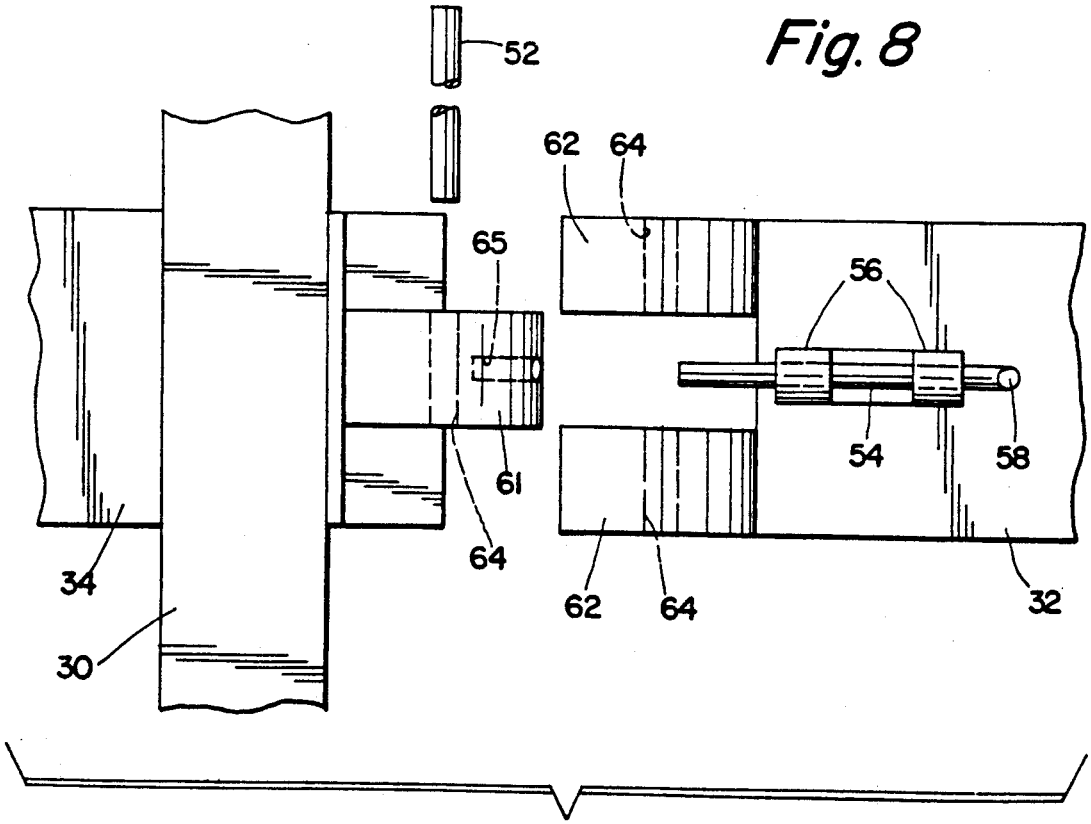
FIG. 9 is an exploded fragmentary front view of the hinging pivot means described in the preceding paragraph.

FIGS. 8 and 9 show details of the pivot hinge means about which braces 32 and 34 bend. A male hinge knuckle 61 on either brace interdigitates with a pair of hinge knuckles 62 on the other brace, pivoting about a pivot pin 52 inserted into a bore 64 through all three knuckles configured so as to receive the pin. Fixably mounted onto one of the braces, preferably the brace onto which the pair of receiving knuckles are mounted, is a locking pin 54 which serves to lock the braces in their fully opened position. The locking pin 54 slides through a pair of locking pin annular collars or rings 56. The locking pin 54 slides into a receiving bore 65 positioned so as to only be able to receive the locking pin when the braces are fully open and extended to a 180 degree orientation with respect to each other. The locking pin is illustrated in locked position 58 and unlocked position 60. Additionally, the locking pin can be spring biased so as to snap into lock position when the locking pin 54 is correctly oriented over the locking pin receiving bore 65.

Figure 10:
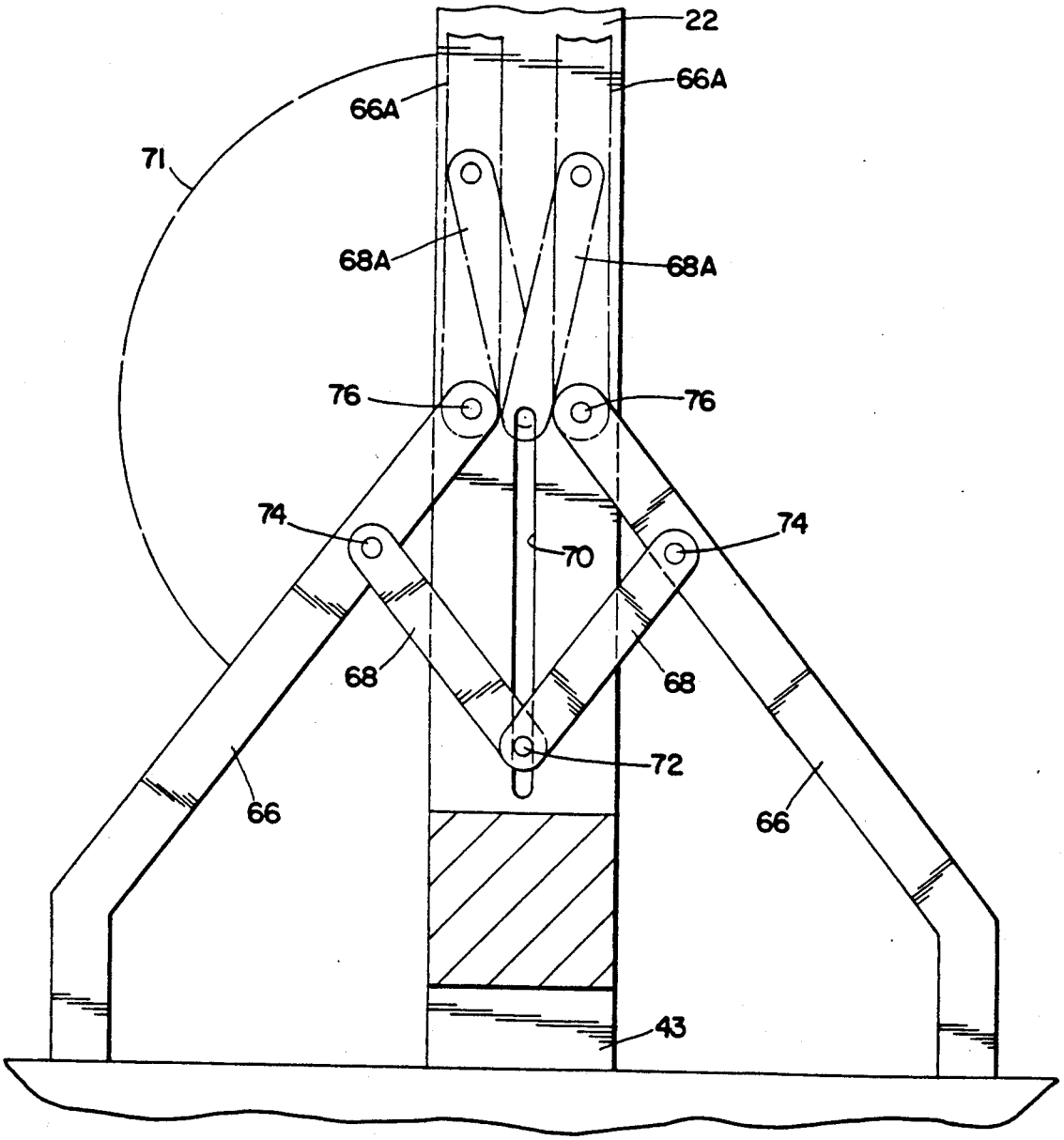
FIG. 10 is a fragmentary side view illustrating an embodiment of a device for increasing the stability of the sawhorse when it is used to support loads in its upright, lengthwise orientation.

Turning now to FIG. 10, there is illustrated in side view a pair of auxiliary brace legs 66 that are additionally available to help stabilize the sawhorse when it is oriented upwards on its lengthwise axis. The auxiliary legs rotate partially about points 76, and are stabilized by two hinge brackets 68 that themselves rotate partially about points 72 and 74, and that additionally are limited in their ability to move sideways by having a hinge means at point 72 be fitted into a trough 70 that restrains a hinge means at point 72 to motion that is substantially parallel to the cross beam 22. When the auxiliary legs are not in use they are folded up in juxtaposition to the cross beam 22 in position 66A, while the hinge brackets are in position 68A. In operation, the auxiliary brace legs 66 swing from closed position to open position along arc 71. The angular and lineal dimensions of the auxiliary brace legs 66 are pre-determined to provide a level base in conjunction with the length of the beam extensions 43.

In order to provide sawhorses of the type described above, they are preferentially fabricated of relatively lightweight materials strong enough to support heavy loads and not susceptible of rust, corrosion or splintering. While many materials are available for fabrication of the present invention, thermoplastics are an especially good choice of materials. To support heavy loads comparable to a similarly dimensioned wooden sawhorse, the material should be able to withstand a compressive or tensile stress of at least 1,000 psi, and have a flexural modulus of at least 7,500 psi. Suitable plastic materials that may be used include acrylonitrile-butadiene-styrene copolymers, polyethylene and polypropylene and copolymers thereof, polyurethane, polystyrene, polypropylene, polycarbonate, thermoplastic polyesters, and all of the above with reinforcing agents such as fiber glass.

While the invention has been described and illustrated with reference to certain prepared embodiments thereof, those skilled in the art will appreciate that various changes, modifications and substitutions can be made therein without departing from the spirit and scope of the invention. It is intended therefore that the following claims be interpreted as broadly as is reasonable.

What is claimed is:

1. A collapsible horse, capable of supporting downward-bearing loads on any one of three possible orientations along its height, length or breadth, comprising:

(a) a cross beam member of pre-determined length;

(b) at least two pairs of legs connected to said cross beam member, which leg pairs are laterally disposed along said cross beam member, and are downwardly divergent in a plane transverse to that of said cross beam member;

(c) two base beam members running substantially parallel to said cross beam member, having substantially similar length as that of said cross beam member and to which said pairs of legs are connected; and (d) a plurality of base beam braces in one-to-one association with each of said pairs of legs, each brace being pivotally connected to said base beam members and each brace being pivotable about a hinge means.

2. The device as claimed in claim 1, in which said leg pairs are fixably connected to said cross beam member.

3. The device as claimed in claim 1, in which said leg pairs are connected by hinging means.

4. The device as claimed in claim 1, in which one leg of each of said pairs is fixably connected to said cross beam member and the other leg of each of said pairs is connected by hinging means to said first leg of each leg pair.

5. The device as claimed in claim 4, in which said hinge means that connects said pairs of legs to said cross beam member comprises at least one pair of spaced knuckles on one of each of said leg pairs and one knuckle on the juxtaposed leg of each of said pairs, the single knuckle interdigitating between the spaced knuckles on the juxtaposed leg, with the legs pivoting in a fixed arc about a pin inserted into a bore transversely running through said single and paired knuckles.

6. The device as claimed in claim 1, further comprising three pairs of legs.

7. A collapsible horse, capable of supporting downward-bearing loads on any one of three possible orientations along its height, length or breadth, comprising;

(a) a cross beam member of pre-determined length;

(b) at least two pairs of legs connected to said cross beam member, which leg pairs are laterally disposed along said cross beam member, and are downwardly and outwardly divergent in a plane transverse to that of said cross beam member, which downward divergence is limited to a predetermined range by a stop means on said hinge means;

(c) two base beam members running substantially parallel to said cross beam member, having substantially similar length as that of said cross beam member and to which said pairs of legs are connected;

(d) a plurality of base beam braces in one-to-one association with each of said pairs of legs, each brace being pivotally connected by a hinge means to said base beam members, each brace being pivotable about a hinge means; and (e) a brace assist member running substantially parallel to said cross beam, having substantially similar length as said cross beam, and being fixably attached to said base beam braces.

8. The device as claimed in claim 7, in which said brace assist member is fixable attached substantially juxtaposed to said hinge means of each of said base beam braces.

9. The device as claimed in claim 7, in which said hinge means of said base beam brace permits pivoting motion in one direction only.

10. The device as claimed in claim 9, in which said hinge means permits pivoting in the direction towards said horse.

11. The device as claimed in claim 7, in which the downward divergence of said pairs of legs is limited to a predetermined range by a stop means comprising said base beam brace.

12. A collapsible horse, capable of supporting downward-bearing loads on any one of three possible orientations along its height, length or breadth, comprising:

(a) a cross beam member of pre-determined length;

(b) at least two pairs of legs connected by hinge means to said cross beam member, which leg pairs are laterally disposed along said cross beam member, and are downwardly and outwardly divergent in a plane transverse to that of said cross beam member, which downward divergence is limited to a predetermined range by a stop means on said hinge means;

(c) two base beam members running substantially parallel to said cross beam member, having substantially similar length as that of said cross beam member and to which said pairs of legs are connected;

(d) a plurality of base beam braces in one-to-one association with each of said pairs of legs, each brace being pivotable about a hinge means inwardly;

(e) a brace assist member running substantially parallel to said cross beam, having substantially similar length as said cross beam, and being hingeably attached to said base beam braces in a manner permitting free inward pivoting of said base beam braces; and (f) three support members fixably attached to and running coaxially with said cross beam member and said base beam members substantially at one end of said horse.

13. The device as claimed in claim 12, in which said support members extend a pre-determined length coaxially with said cross beam and base beams, beyond a plane formed by that base beam brace and that pair of legs substantially at one end of said horse.

14. The device as claimed in claim 12, in which said base beam brace pivot hinge means is capable of being locked into a desired position by a means for such locking.

* * * * *